United States Patent [19]

Buttemer

[11] Patent Number: 4,727,372

[45] Date of Patent: Feb. 23, 1988

[54] DETECTION SYSTEM

[75] Inventor: David A. Buttemer, Natal, South Africa

[73] Assignee: Electromatic (Proprietary) Limited, Pietermaritzburg, South Africa

[21] Appl. No.: 642,264

[22] Filed: Aug. 20, 1984

[51] Int. Cl.[4] ..... G08C 1/00

[52] U.S. Cl. ..... 340/941; 340/935; 246/247; 246/249

[58] Field of Search ..... 340/941, 935; 324/217, 324/218, 226, 227, 232, 233, 234, 236, 239, 243; 246/247, 249

[56] References Cited

U.S. PATENT DOCUMENTS

| | | | |
|---|---|---|---|
| 2,532,231 | 5/1949 | Jarvis | 340/941 |
| 3,178,685 | 4/1965 | Pettitt | 246/249 |
| 3,205,352 | 9/1965 | Prucha | 246/249 |
| 3,500,039 | 3/1970 | Kortyna | 246/247 |
| 3,964,703 | 6/1976 | Wilkas et al. | 246/247 |
| 4,128,218 | 12/1978 | Pohlig | 246/247 |

*Primary Examiner*—John W. Caldwell, Sr.
*Assistant Examiner*—Mahmoud Fatahi-yar
*Attorney, Agent, or Firm*—Spencer & Frank

[57] ABSTRACT

A railway detection system in which the presence of a train is detected by means of first inductive loop apparatus. When the train is detected second inductive loop apparatus is enabled to detect the passage of wheels of the train.

5 Claims, 3 Drawing Figures

DETECTION SYSTEM

BACKGROUND OF THE INVENTION

This invention relates generally to a system for detecting the passage or presence of an object. The invention finds particular application in the detection of vehicles and especially rolling stock or tracked vehicles. The invention will hereinafter be described with particular reference to the detection of tracked vehicles such as trains but it is to be understood that the scope of the invention is not limited in any way to this specific application.

Apparatus for detecting the passage of a train along a rail track must be capable of operating under widely ranging environmental conditions and of distinguishing between genuine signals and spurious signals which may arise from a variety of causes ranging from electrical noise originating from electric power lines, and thermal drift, to physical disturbances of the apparatus which may be caused for example by a workman's spade or pick.

In one prior art detection device a spaced transmitter and receiver are arranged so that a train's wheels pass between them and interfere with a transmitted electromagnetic signal. From the physical point of view the transmitter and receiver are exposed and are susceptible to mechanical damage whereas from the electrical point of view the system is affected by electrical noise and is not always suitable for the detection of trains moving at high speeds.

In another system known to the applicant amplitude variations in an electromagnetic field which are caused by the passage of a train are detected. This approach is highly susceptible to the influence of electrical noise.

SUMMARY OF THE INVENTION

It is an object of the present invention to provide an improved method of detecting an object.

The invention provides a method of detecting an object which includes the steps of establishing an electromagnetic field, and detecting a change in the frequency of the field, of at least a predetermined amount, due to the presence of the object in the field.

The method may include the further step, on detection of the object, of initiating a secondary detection method.

In accordance with the invention the secondary detection method includes the steps of establishing a second electromagnetic field and detecting a change in the frequency thereof due to the presence of the object, or at least one device associated or engaged with the object, in the field.

A third electromagnetic field may be established, preferably substantially simultaneously with the second field, the two fields being physically spaced from each other, each field being monitored for at least a predetermined frequency variation due to the presence or passage of the object or a device associated therewith, and directional information relating to the object or device may be derived therefrom.

The method of the invention finds application in many fields, and is particularly suited for detecting the passage of vehicles including tracked vehicles such as trains. In the last mentioned case the primary detection method is used to detect a train, and the secondary detection method is employed to detect the directional passage of axles of the train, and to provide a count thereof.

The invention also includes a method of detecting an object which includes the steps of establishing an electromagnetic field, monitoring the frequency of the field, varying the frequency of the field when the frequency drifts and a frequency change endures for at least a predetermined period, and detecting a change in the frequency of the field due to the presence of the object in the field.

According to a different aspect of the invention there is provided a method of detecting at least one device which is associated with an object which includes the steps of using first apparatus to detect the object and, when the object is detected, using second apparatus to detect the device.

The invention further extends to a method of detecting an object which includes the steps of establishing at least two electromagnetic fields, detecting changes in the frequencies of the fields due to the presence of the object in the respective fields, generating signals which are respectively dependent on the frequency changes, and combining the signals to produce a composite signal.

According to a first form of the invention there is provided apparatus for detecting an object which includes means for establishing an electromagnetic field, and means for detecting a change in the frequency of the field, of at least a predetermined amount, due to the presence of the object in the field.

The means for establishing the field may be oscillator means connected to a resonant circuit. The resonant circuit may include an inductive loop and a shunt capacitance.

The inductive loop may be embedded in a weatherproof material. A suitable material for this purpose is glass fibre reinforced concrete.

The means for detecting the frequency change may include a phase locked loop which produces an output signal which is dependent on the frequency of the field, and means for detecting at least a predetermined minimum variation in a parameter of the output signal.

In a second form of the invention the apparatus includes first and second means for establishing first and second electromagnetic fields respectively, first and second detection means for detecting changes in the frequencies of the two fields respectively due to the passage of an object through the fields, and means for deriving directional information relating to the object from the detection means.

The two detection means may produce analog output signals of opposite sense.

In accordance with the invention apparatus according to the first form of the invention may be combined with apparatus according to the second form of the invention, and the latter apparatus is enabled only when the former apparatus positively detects the object.

The invention also provides apparatus for detecting at least one device which is associated with an object which includes first means for detecting the object, and second means, which is enabled when the first means detects the object, for detecting the device.

The invention further extends to apparatus for detecting an object which includes means for establishing at least two electromagnetic fields, means for detecting changes in the frequencies of the fields due to the presence of the object in the respective fields and for generating signals which are respectively dependent on the frequency changes, and means for combining the signals to produce a composite signal.

BRIEF DESCRIPTION OF THE DRAWINGS

The invention is further described by way of example with reference to the accompanying drawings in which.

DESCRIPTION OF PREFERRED EMBODIMENT

Figure 1:
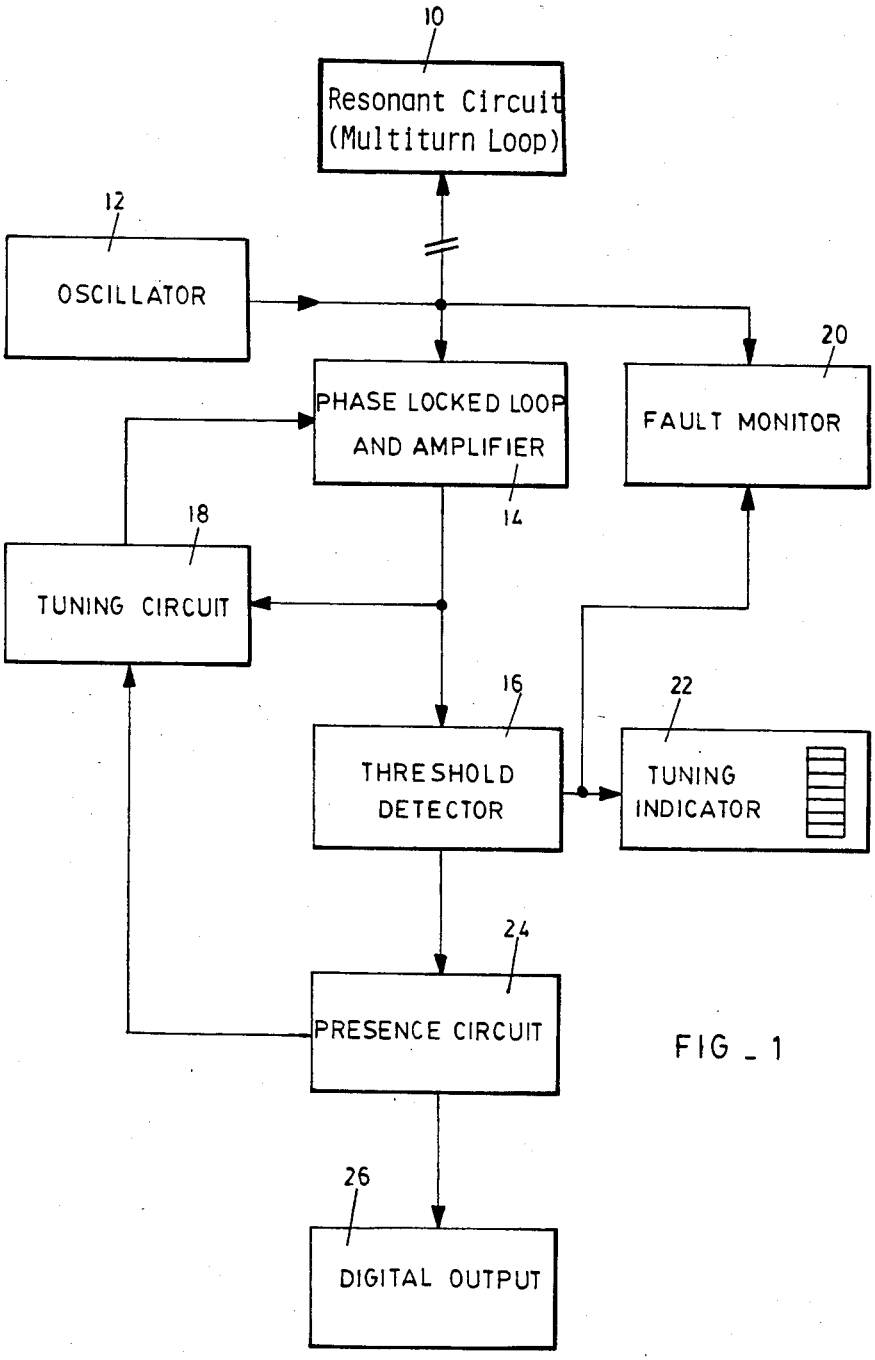
FIG. 1 illustrates in block diagram form apparatus according to a first form of the invention.

FIG. 1 illustrates a circuit of apparatus according to a first form of the invention which may be described in general terms as an inductive loop detector.

The apparatus includes a multiturn loop 10, an oscillator 12, a phase locked loop 14, a threshold detector 16, a tuning circuit 18, a fault monitor 20, a tuning indicator 22, a presence circuit 24 and digital output circuitry 26.

Figure 3:
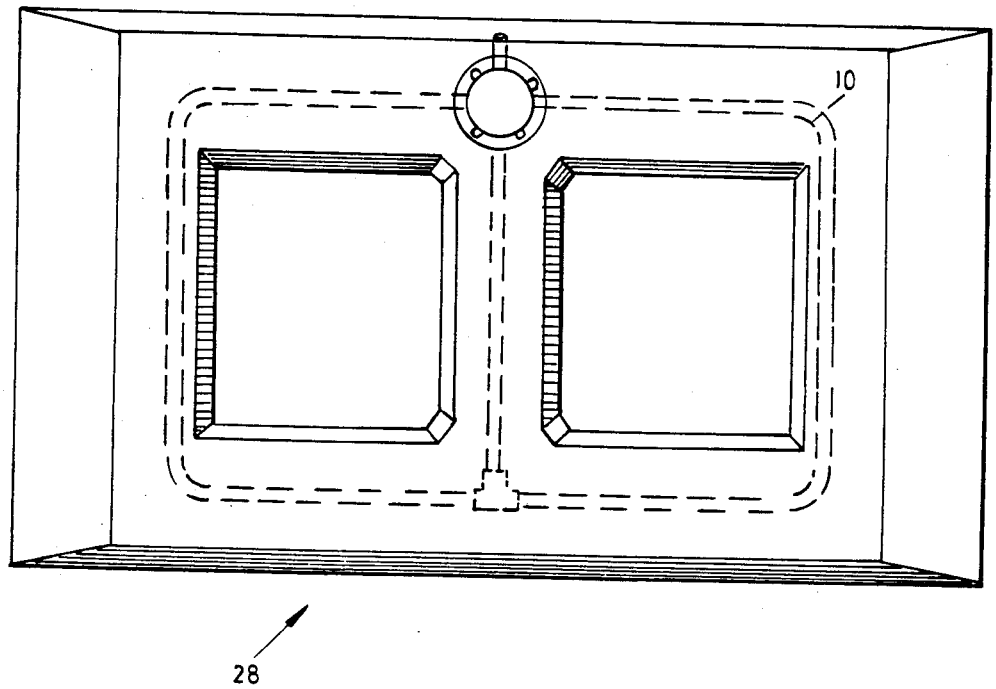
FIG. 3 illustrates the physical construction of a loop used with the apparatus of FIG. 1.

The multiturn loop 10 is embedded in glass fibre reinforced concrete and this component, designated by the reference numeral 28, has the physical appearance illustrated in FIG. 3. The use of glass fibre reinforced concrete for this purpose has a number of advantages. The material is easily formed into the desired shape with the desired dimensional accuracy and it is very robust. It is well suited for installation outdoors under the arduous conditions encountered in remote installations on rail tracks and is weatherproof.

The multiturn loop 10 constitutes an inductance and this together with a shunt capacitance, not illustrated, forms a resonant circuit. The resonant circuit is tuned to resonance at the output frequency of the oscillator 12. The phase locked loop 14 is locked to the oscillator frequency and is used to detect frequency variations in the resonant circuit. The phase locked loop produces an output signal which is applied to the threshold detector 16. The amplitude of the output signal is proportional to the difference in frequency between an internal oscillator in the loop and the frequency of the resonant circuit. The detector 16 is set to produce an output signal when its input signal varies by at least a predetermined amount, this amount therefore corresponding to a change in the operating frequency of the loop of at least a predetermined amount.

The tuning circuit 18 compensates the phase locked loop output voltage for circuit drift which may occur due to thermal variations or as the components age. This is effectively an A.C. coupled circuit having extremely long time constants. Another important function of the tuning circuit 18 is to tune the loop 14 to allow for the presence of a metallic object in the active area of the loop for an extended period. For example when a metallic object is within the active area of the loop 10 the operating frequency of the resonant circuit is altered and this is detected by the phase locked loop 14. If the frequency variation is sufficiently high the threshold detector 16 switches and the presence circuit 24 is enabled. The presence circuit 24 is akin to a timer in that it will initiate operation of the tuning circuit 18 once the detector 16 has been in the switched mode for a predetermined time.

The operation of the circuit of FIG. 1 is as follows: Assume for the sake of example, although this is by no means limiting, that the component 28 which contains the multiturn loop 10 is installed between the tracks of a railway line. The oscillator 12 establishes an electromagnetic field in the resonant circuit formed by the loop 10 and its associated shunt capacitor. The threshold detector 16 is tuned to respond to a predetermined variation in the output signal of the phase locked loop 14. If the circuit is intended to detect the passage of a train this variation will be determined at least empirically and will be sufficient so that the circuit does not respond to the presence of minor metallic objects which are substantially smaller than a train. The setting of the detector 16 is displayed on the tuning indicator 22.

On passage of a train past the loop the electromagnetic field is affected. On the one hand eddy current losses arise due to the interaction of the electromagnetic field with the metallic components of the train and, on the other hand, the inductance of the loop is increased due to the presence of the metallic object which is coupled to the loop. The result is a change in the inductance of the loop and this is reflected in a change in the operating frequency of the resonant circuit. The frequency variation is detected by the phase locked loop 14, in the manner described, and if the frequency variation is sufficiently large indicating that it is due to the presence of a train, the threshold detector 16 is switched.

The presence circuit 24 monitors the duration of the change in the status of the output signal of the detector 16. If the output signal maintains a changed status for a predetermined period, thus indicating that the train is stationary over the loop 10, the circuit 24 initiates operation of the tuning circuit 18 and the A.C. coupling of the phase locked loop 14 is adjusted to compensate for the altered frequency prevailing in the resonant circuit. Thus the presence circuit 24 enables the presence of stationary objects which affect the loop 10 to be compensated for and in similar fashion the circuit is retuned or adapted to allow for variations in the physical environment in which it is installed. Once this is done variations in the frequency of the electromagnetic field due to the presence or passage of additional objects can be detected.

The presence circuit 24 in addition provides an output to the circuitry 26 which denotes the presence or passage of an object which meets the parameters within which the circuit functions. The output signals can be accumulated in the circuitry 26 and digitized for communications purposes.

Figure 2:
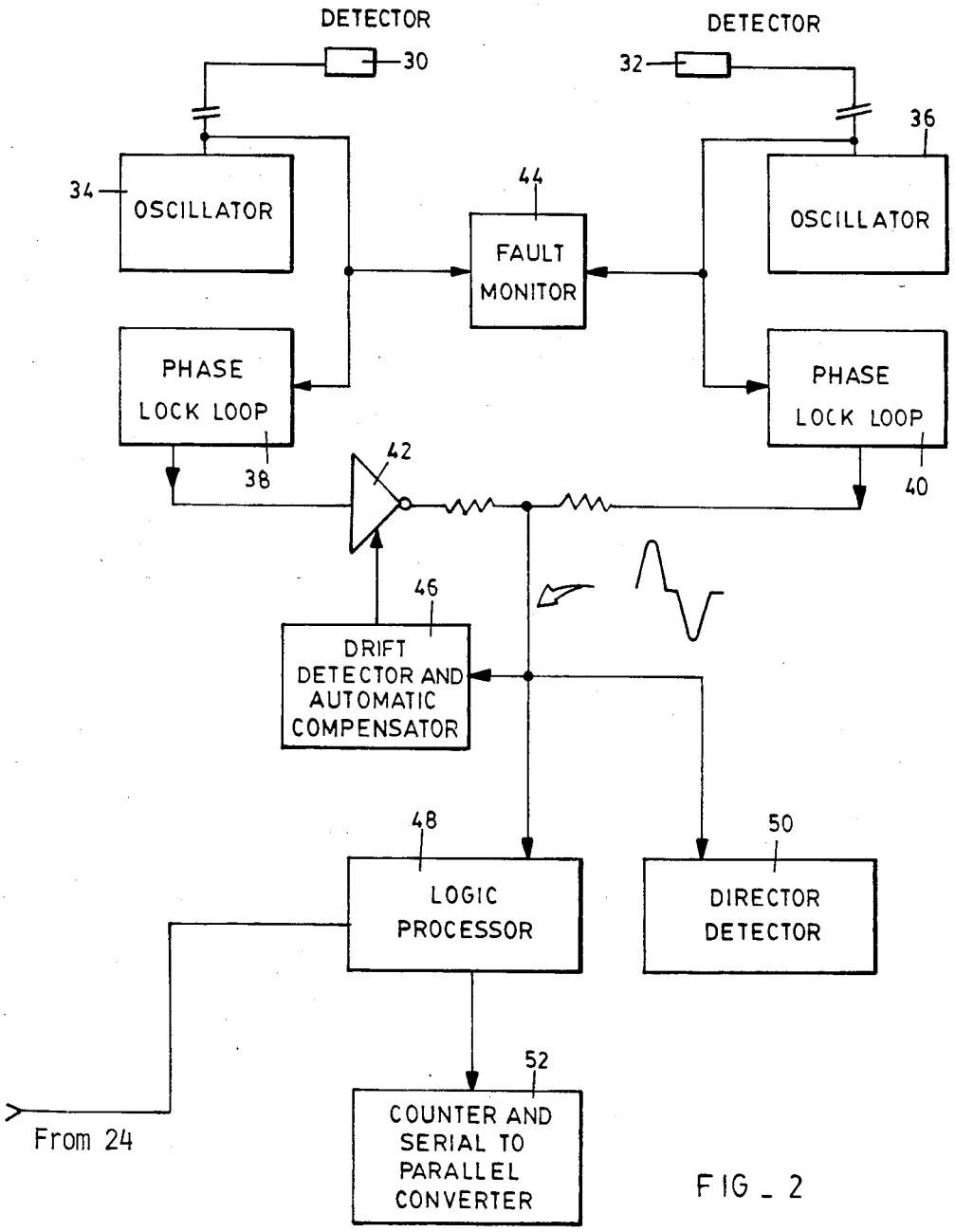
FIG. 2 illustrates in similar fashion apparatus according to a second form of the invention which in certain applications is combined with the apparatus of FIG. 1.

The circuitry of FIG. 2 is in many respects similar to that shown in FIG. 1. Certain portions are however duplicated so that additional and backup information is available from the circuit.

In this particular case the circuit of FIG. 2 is designed to detect the axles of a train and the circuit will be described in this context. Its principles are however not limited in any way to this particular application. The circuit of FIG. 2 includes axle detectors 30 and 32 respectively, oscillators 34 and 36 respectively which operate at distinct frequencies, phase locked loops 38 and 40 respectively, an inverting circuit 42, a fault monitor 44, compensating circuitry 46, logic processor 48 and director detector 50, and a counter and serial to parallel converter 52.

Each of the axle detectors 30 and 32 includes a resonant circuit. The axle detectors are compact devices and are installed on the web of a rail track so that they are protected by the head of the track and are exposed to the flanges of wheels on the track. The detectors permit free passage of the wheels.

The resonant circuits of the detectors are powered by the respective oscillators 34 and 36 and variations in the operating frequencies of the resonant circuits, caused for example by the passage of a wheel flange past the detectors, are detected by means of the loops 38 and 40 in the general manner already described.

The output signal of the loop 38 is inverted by the inverter 42 and this is then combined with the output signal of the loop 40. Thus the combined signal which results from the passage of a wheel flange past the two detectors 30 and 32 is an analog signal with two components one of which is positive and the other of which is negative. A typical signal is illustrated in an inset drawing in FIG. 2.

In accordance with the invention a signal input to the logic processor 48 is identified as positively indicating the passage of a wheel flange only if it has both the positive and negative components referred to. This duality is a good back up. On positive identification of a wheel flange a count is output to the converter 52 where it is accumulated. Thus the converter 52 contains a count of the number of wheel flanges which have passed the detectors 30 and 32.

The signal applied to the logic circuitry 48 is also applied to the circuit 50. This circuit senses the positive and negative components of the signal, and their order, and relates them to the physical positions of the detectors 30 and 32, thereby producing a signal which indicates the direction in which the wheel flange passed the detectors.

When the circuits of FIGS. 1 and 2 are combined the logic processor 48 is enabled only when a train is positively identified by the circuitry of FIG. 1. Thus, in combination, the apparatus of FIG. 1 functions to detect the presence or passage of a train and when it does so detect a train the circuit of FIG. 2 is enabled to permit a count to be made of the axles of the train and for information to be generated which indicates the direction of train movement.

A number of advantages pertains to the circuit of FIG. 2. In the first place the use of two detectors permits directional information to be obtained. Secondly since the outputs of the detectors are combined with one of the signals being inverted a common mode noise rejection system is provided which permits the signal due to the presence of an axle to be discriminated from noise signals arising inter alia from track currents.

When the circuit is used in combination with the apparatus of FIG. 1 the axles are positively identified. The likelihood of an identification signal being generated which arises from the presence of any other body is largely eliminated for the apparatus is only enabled when the presence of a train is sensed by the circuit of FIG. 1. Another benefit which flows from combining the two circuits is that the total count of axles is available immediately for data transfer purposes when the train clears the loop 10. There is therefore no need for a timing out period before data can be transferred.

With regard to each of the circuits the principle of detecting a change in operating frequency ensures a high degree of reliability and accuracy of count and detection in noisy environments. This is particularly so where immunity to mains frequencies and harmonics thereof is essential. Since the circuitry responds in each case to frequency variations, which are instantaneous, it is possible to detect trains and axles moving at high speeds. This should be contrasted with the situation which prevails when for example amplitude variations are detected in which event it may be necessary to dampen oscillations before an accurate comparison or reading of the amplitude level can be obtained.

Many applications of the invention are possible. In respect of a train data on the train is generated and this is available for further processing. The data can also be used to provide information at level crossings for generating warning signals indicating the passage of a train or for controlling safety apparatus.

The principles of the invention have been described with particular reference to trains. The techniques may clearly be adapted to detect other vehicles or objects.

What is claimed is:

1. A method of detecting a device which includes the steps of using two oscillators to establish first and second electromagnetic fields which are physically spaced from each other, detecting changes in the frequencies of the first and second fields due to the presence of the device in the respective fields, generating first and second analog signals which are respectively dependent on the frequency changes of the first and second fields, inverting the polarity of the second signal, combining the first signal and the inverted second signal to produce a composite signal, and sensing positive and negative components of the composite signal to provide an indication of the presence of the device.

2. A method according to claim 1 wherein the device moves through the fields, and which includes the step of analyzing the composite signal to derive information on the direction of movement of the device relatively to the electromagnetic fields.

3. Apparatus for detecting a wheel on a vehicle, comprising:

first and second electromagnetic field establishing means, each including an oscillator, for establishing first and second electromagnetic fields, respectively, said first and second field establishing means being positioned for causing the fields to be spaced apart; first and second detection means each connected to a respective one of said first and second field establishing means for generating respective first and second analog signals each dependent on the change in frequency of a respective one of the first and second fields due to the presence of a vehicle wheel in the respective field; signal processing means connected to said second detection means for inverting the polarity of the second signal; combining means connected to said first detection means and said signal processing means for combining the first and inverted second signals to produce a composite analog signal; and logic means connected to said combining means for responding to positive and negative components in the composite signal thereby to indicate the presence of a wheel.

4. Apparatus according to claim 3 in which the first field establishing means includes an oscillator which is connected to a resonant circuit, the resonant circuit having an inductive loop which is embedded in a weatherproof material.

5. Apparatus according to claim 4 in which the weatherproof material is glass fibre reinforced concrete.

* * * * *